United States Patent [19]

Kohmura et al.

[11] Patent Number: 4,562,140

[45] Date of Patent: Dec. 31, 1985

[54] PHOTOSENSITIVE MATERIAL FOR USE IN DIFFUSION TRANSFER PROCESS WITH MATTING AGENTS IN UNDERLAYER

[75] Inventors: Isao Kohmura; Jun Miura; Norio Kajima, all of Nagaokakyo, Japan

[73] Assignee: Mitsubishi Paper Mills, Ltd., Tokyo, Japan

[21] Appl. No.: 659,887

[22] Filed: Oct. 11, 1984

[30] Foreign Application Priority Data

Oct. 19, 1983 [JP] Japan ..... 58-195841

[51] Int. Cl.[4] ..... G03C 5/54; G03C 1/96

[52] U.S. Cl. ..... 430/244; 430/207; 430/227; 430/230; 430/496; 430/523; 430/950; 430/954

[58] Field of Search ..... 430/207, 227, 230, 244, 430/950, 954, 523, 496, 510

[56] References Cited

U.S. PATENT DOCUMENTS 3,370,951 2/1968 Hasenauer et al. ..... 430/950

*Primary Examiner*—Richard L. Schilling

*Attorney, Agent, or Firm*—Cushman, Darby & Cushman

[57] ABSTRACT

Disclosed is a photosensitive material which comprises a support and at least an undercoating layer and a silver halide emulsion layer, said undercoating layer containing a matting agent having an average particle size larger than the thickness of the undercoating layer. Use of this photosensitive material for diffusion transfer process causes neither slipping between the photosensitive material and the image receptive layer nor pinholes in silver images.

10 Claims, No Drawings

PHOTOSENSITIVE MATERIAL FOR USE IN DIFFUSION TRANSFER PROCESS WITH MATTING AGENTS IN UNDERLAYER

BACKGROUND OF THE INVENTION

This invention relates to the diffusion transfer process and, more particularly, to a silver halide photosensitive material for use in said process.

The principle of silver complex diffusion transfer process (referred to as DTR process) is disclosed in U.S. Pat. No. 2,352,014 and is well known. In the DTR process, a silver halide is imagewise transferred, by diffusion, from a silver halide emulsion layer to an image receptive layer and converted therein to a silver image in the presence of physical development nuclei in most cases. For this purpose, the imagewise exposed silver halide emulsion layer is disposed in contact with or brought into contact with an image receptive layer in the presence of a developing agent and a silver halide complexing agent so that the unexposed silver halide may be converted into a soluble silver complex; the silver halide in exposed areas of the silver halide emulsion layer is developed into silver (chemical development) and, as a consequence, becomes insoluble and nondiffusible. The soluble silver complex formed from the silver halide in unexposed areas of the silver halide emulsion layer is transferred to an image receptive layer wherein it is developed generally in the presence of development nuclei; in the case of a direct positive silver halide emulsion, such behaviors of silver halide become reversed in both the exposed and unexposed areas.

In the DTR process which operates in the above-mentioned manner, the quality of the finished image receptive material such as, for example, the density, tone, and contrast of the image and the storage stability of the resulting reproduced image becomes important. Although, in some cases, a continuous tone original is reproduced on the image receptive material, yet a higher contrast, sharpness, and resolution are required when the finished image recptive material is used in the reproduction of books and printed documents or as block copy for printing plate making.

Even though a photosensitive material, image receptive material, and processing solutions are designed to reproduce an excellent image, it is impossible to achieve the intended result, if there occurs slipping between said materials which must remain in tight contact with the coated sides facing each other during the development. It is readily conceivable that the slipping which takes place between two materials has something to do with the tackiness of the coating layer. In fact, the slippage becomes enhanced when the developer contains a thickening agent such as carboxymethylcellulose, hydroxyethylcellulose, or the like. It is a common practice to incorporate a matting agent to roughen the surface of a photosensitive material in order to keep a photosensitive material from becoming tacky or adherent and to prevent the accumulation of static charge. The slipping between the two materials in tight contact can thus be prevented by the incorporation of a matting agent in the surface layer.

Now, the present inventors confirmed that in the silver image areas formed on an image receptive material, there exist tiny spots of pin-point size which are devoid of silver (such tiny spots are referred to as pinholes) and that even if such pinholes are so tiny that they do not impair the practical quality of reflection image, yet they become conspicuous in number in the case of transparency image such as that formed on a transparent film support. Such pinholes seem, by inference based on the result, to be caused by the locally hindered diffusion of the silver complex from the photosensitive material to the image receptive layer. Although the exact cause for the emergence of pinholes is not yet fully elucidated, the present inventors have succeeded in ascertaining that one of the important factors is the presence of a matting agent in the surface layer of photosensitive materials.

SUMMARY OF THE INVENTION

There is, therefore, a demand for the development of a photosensitive material free from the slipping between the photosensitive material and the image receptive material when both materials are held together face to face in close contact and, in addition, free from the emergence of pinholes. An object of the present invention is to provide such a photosensitive material.

The above object has been achieved by a photosensitive material for the diffusing transfer process having at least an undercoating layer and a silver halide emulsion layer on a support, which is characterized by being incorporated in said undercoating layer with a matting agent having an average particle size larger than the thickness of said undercoating layer.

DESCRIPTION OF THE INVENTION

The invention is described in detail in the following.

A common photosensitive material for use in the silver complex diffusion transfer process comprises at least one silver halide emulsion layer disposed on a support. The silver halide is applied generally at a coverage of 0.5 to 5 g in terms of silver nitrate per square meter. It is also known that in addition to the silver halide emulsion layer, there are provided, if necessary, auxiliary layers such as undercoating layer, intermediate layer, protective layer, or stripping layer, and a backing layer. Further, the photosenisitive material of the present invention can be provided with a covering layer of water-permeable binders laid over the silver halide emulsion layer to insure a uniform transfer. Examples of suitable binders are, as described in Japanese Patent Publication Nos. 18,134/63 and 18,135/63, methylcellulose, carboxymethylcellulose sodium salt, and sodium alginate. The covering layer should be of small thickness in order not to hinder or retard the diffusion.

The hydrophilic binders used advantageously in the silver halide photosensitive material of this invention to prepare the photosensitive emulsion include lime-treated gelatin, acid-treated gelatin, gelatin derivatives (for example, those described in Japanese Patent Publication 4,854/63, 5,514/64, 12,237/65, and 26,345/67; U.S. Pat. Nos. 2,525,753, 2,594,293, 2,614,928, 2,763,639, 3,118,766, 3,132,945, 3,186,846, and 3,312,553; Brit. Pat. Nos. 861,414 and 1,033,189); proteins such as albumin and casein, cellulosic substances such as carboxymethylcellulose and hydroxyethylcellulose; natural polymers such as agar and sodium alginate; and synthetic hydrophilic binders such as polyvinyl alcohol, polyN-vinylpyrrolidone, polyacrylic acid copolymer, polyacrylamide, derivatives thereof, and partial hydrolyzates thereof. These binders are used each alone or in combinations. They are also used in forming nonsensitive layers such as an undercoating layer or an image receptive layer. The amount of binder in silver halide emulsion layer is 2.5 parts or less, preferably 1.5 parts or less by weight for 1 part by weight of silver halide in terms of silver nitrate.

The silver halide can be any of the silver chloride, silver bromide, silver chlorobromide, and combinations of these halides with silver iodide. The silver halide emulsion can be spectrally sensitized to blue, green, or red by the incorporation of merocyanine, cyanine or other sensitizing dyes. Further, the silver halide emulsion can be chemically sensitized with various sensitizers such as sulfur sensitizers (e.g. sodium thiosulfate, thiourea, and gelatin containing labile sulfur), noble metal sensitizers (e.g. gold chloride, gold thiocyanate, ammonium chloroplatinate, silver nitrate, silver chloride, palladium salts, rhodium salts, iridium salts, and ruthenium salts), polyalkylenepolyamine compounds described in U.S. Pat. No. 2,518,698, iminoaminomethanesulfonic acid described in German Pat. No. 1,020,864, and reduction sensitizers (e.g. stannous chloride).

An undercoating layer containing a matting agent is provided underneath the silver halide emulsion layer. The undercoating layer preferably contains a pigment such as carbon black or a dye to serve also as an antihalation layer. The amount of a hydrophilic binder in the undercoating layer can be any, but is generally in the range of from about 1 to about 8 g/m$^2$. The average particle size of a matting agent in the undercoating layer should be larger than the thickness of the layer and is generally about 1 to about 20 $\mu$m, preferably from about 2 to about 10 $\mu$m. The average particle size is preferably about 1.1 or more times the thickness of undercoating layer and can be equal to or larger than the total thickness of the undercoating layer, emulsion layer, and a protective layer which is provided if necessary. The matting agent content of the undercoating layer is 0.1 to 30, preferably 0.2 to 10, % by weight based on hydrophilic binder. The matting agent of the particle size in accordance with the thickness of undercoating layer (and emulsion layer, etc.) can be freely selected from known substances [cf. Japanese Patent Application "Kokai" (Laid-open) Nos. 116,143/78 and 104,133/82]. The matting agents known to be typical of them are inorganic or organic powders such as silica, titanium dioxide, magnesium oxide, barium sulfate, calcium carbonate, polystyrene, alkylated polystyrenes, and (meth-)acrylic esters. The silver halide emulsion layer should substantially not be incorporated with matting agent having an average particle size larger than the thickness of the layer, the allowable amount of such a matting agent being one-tenth or less of the amount added to the undercoating layer.

The constitutive elements of the present silver halide photosensitive material can include the following additives: Hardening agents such as, for example, formaldehyde, mucochloric acid, chrome alum, vinylsulfone compounds, epoxy compounds, and ethyleneimine compounds; antifoggants and stabilizers such as mercapto compounds and tetrazaindene; surface active agents such as saponine, sodium alkylbenzenesulfonate, salts of sulfosuccinic esters; anionic compounds such as alkylarylsulfonates described in U.S. Pat. No. 2,600,831; amphoteric compounds such as those described in U.S. Pat. No. 3,133,816; optical whitening agents such as those described in Japanese Patent Publication No. 7,127/59; wetting agents such as waxes, higher fatty acid glycerides, and higher alcohol esters; mordants such as N-guanylhydrazone compounds, quaternary onium compounds, and tertiary amines; antistatics such as diacetylcellulose, styrene-perfluoroalkylene sodium maleate copolymer, alkali salts of the reaction product of styrene-maleic anhydride copolymer and p-aminobenzenesulfonic acid; agents for improving film properties such as various latices; plasticizers for gelatin such as glycerol and those described in Japanese Patent Publication No. 4,939/68; thickening agents such as styrene-maleic acid copolymers and those described in Japanese Patent Publication No. 21,574/61; antioxidants and pH regulators.

The supports used in practicing the present invention include plastic films and laminated plastic films such as those of cellulose acetate, cellulose acetate butyrate, polyethylene terephthalate, polystyrene, and polypropylene; synthetic papers; baryta paper; and laminated papers with plastic films of $\alpha$-olefinic polymer such as polyethylene. The support can contain a coloring matter for the purpose of antihalation.

The processing solution used in the diffusion transfer process may contain alkaline substances such as, for example, sodium hydroxide, potassium hydroxide, lithium hydroxide, and trisodium phosphate; silver halide solvents such as, for example, sodium thiosulfate, ammonium thiocyanate, cyclic imide compounds, and thiosalicylic acid; preservatives such as, for example, sodium sulfite; thickening agents such as, for example, hydroxyethyl-cellulose and carboxymethylcellulose; antifoggants such as, for example, potassium bromide and 1-phenyl-5-mercaptotetrazole; development modifiers such as, for example, polyoxyalkylene compounds and onium compounds; developing agents such as, for example, hydroquinone and 1-phenyl-3-pyrazolidone; and alkanolamines. The developing agent in a highly alkaline solution has disadvantage of losing its activity by atmospheric oxidiation. It is known that such a disadvantage can be removed to a large extent by incorporating the developing agent in DTR materials such as silver halide emulsion layer or/and a hydrophilic colloid layer in a waterpermeable relation to the former. In processing such a DTR material containing a developing agent, there is commonly used an alkaline activator solution containing no or substantially no developing agent. The DTR process employing an alkaline activator solution is described in Japanese Patent Publication Nos. 27,568/64, 30,856/72, and 43,778/76.

The invention is illustrated below in detail with reference to Examples but the invention is not limited thereto, because various modifications may be made within the scope of the invention.

EXAMPLE 1

On one side of a subbed polyethylene terephthalate film support, was provided an image receptive layer comprising a mixture of gelatin and carboxymethylcellulose (4:1) and nickel sulfide nuclei, at a coverage of 3 g/m$^2$ in terms of hydrophilic colloids on dry basis.

A photosensitive material (blank specimen) was prepared by providing on a polyethylene-coated paper support an undercoating layer containing carbon black to serve as antihalation layer and further providing on said undercoating layer an orthochromatically sensitized gelatino silver halide emulsion layer containing 1.5 g/m$^2$ in terms of silver nitrate of silver chlorobromide (5 mole-% of silver bromide), 0.3 $\mu$ in average particle size, 0.2 g/m$^2$ of 1-phenyl-4-methylpyrazolidone, and 0.7 g/m$^2$ of hydroquinone. The blank specimen contained gelatin in an amount of 5 g/m$^2$ in the undercoating layer and 1.5 g/m$^2$ in the emulsion layer. After imagewise exposure, the emulsion side of the photosensitive material was brought into contact with the image receiving side of the image receptive material and the resulting assembly was passed through a common development equipment containing a developer of the following recipe designed for the silver complex diffusion transfer process. Fifteen seconds after emergence from a squeeze roll unit, the assembled materials were peeled apart.

Water: 800 ml
Tribasic sodium phosphate, dodecahydrate: 75 g
Sodium sulfite, anhydrous: 40 g
Potassium bromide: 0.5 g
Sodium thiosulfate, anhydrous: 20 g
1-Phenyl-5-mercaptotetrazole: 70 mg
Hydroxyethylcellulose: 3 g
Made up with water to: 1 liter A silver image of high transmission density was obtained on each image receptive specimen. There were about 20 pinholes in an area of 10×10 cm. However, a blurred image due to the slipping between both materials was observed in 4 of 30 consecutively treated image receptive specimens.

A reference specimen was prepared in the same manner as described above, except that the silver halide emulsion contained 5% by weight (75 mg/m$^2$) of silver particles of 7 μm in average size. Upon testing in the same manner as described above, no blurred image was found, but a large number of pinholes were observed in every image receptive specimen (500 pinholes in an area of 10×10 cm).

Two photosensitive material specimens (specimens A and B according to this invention) were prepared in the same manner as described above with respect to the blank specimen, except that the undercoating layer contained 75 mg/m$^2$ (specimen A) or 150 mg/m$^2$ (specimen B) of a silica powder of 7 μm in average particle size. Upon testing as described above, none of the 30 consecutively treated image receptive specimens showed a blurred image. In both specimens A and B, the number of pinholes in an area of 10×10 cm was less than 30.

Another reference specimen was prepared in the same manner as described above with respect to the blank specimen, except that the undercoating layer contained 100 mg/m$^2$ of titanium dioxide of 0.5 μm in particle size. The specimen showed test results similar to those of the blank specimen.

EXAMPLE 2

Two types of specimens according to this invention were prepared in the same manner as described with respect to the specimens A and B in Example 1, except that the undercoating layer contained 3 g/m$^2$ of gelatin in both cases. The test results were similar to those obtained with respect to the specimens A and B in Example 1.

EXAMPLE 3

The procedure of Example 2 was repeated, except that a matting agent, 4 μm in average particle size, of polystyrene or polymethyl methacrylate was used in the undercoating layer in place of the silica powder. There was obtained an excellent transmission image free from blurred image or pinholes.

What is claimed is:

1. A photosensitive material for diffusion transfer process which comprises a support and at least an undercoating layer and a silver halide emulsion layer provided on said support, said undercoating layer containing a hydrophilic binder and a matting agent having an average particle size larger than the thickness of the undercoating layer.

2. A photosensitive material according to claim 1 wherein said matting agent has an average particle size of about 1 to about 20 μm.

3. A photosensitive material according to claim 1 wherein the matting agent has an average particle size of about 1.1 or more times the thickness of the undercoating layer.

4. A photosensitive material according to claim 1 wherein the content of the matting agent in the undercoating layer is about 0.1 to about 30% by weight based on the hydrophilic binder.

5. A photosensitive material according to claim 1 wherein the matting agent is an inorganic or organic powder selected from silica, titanium dioxide, magnesium oxide, barium sulfate, calcium carbonate, polystyrene, alkylated polystyrene and (meth)acrylic esters.

6. A diffusion transfer process which comprises imagewise exposing the photosensitive material according to claim 1 and then diffusion transfer developing the material in contact with an image receiving layer.

7. A diffusion transfer process according to claim 6 wherein matting agent in undercoating layer of the photosensitive material has an average particle size of about 1 to about 20 μm.

8. A diffusion transfer process according to claim 6 wherein matting agent in undercoating layer of the photosensitive material has an average particle size of about 1.1 or more times the thickness of the undercoating layer.

9. A diffusion transfer process according to claim 6 wherein the content of matting agent in the undercoating layer of the photosensitive material is about 0.1 to about 30% by weight based on the hydrophilic binder.

10. A diffusion transfer process according to claim 6 wherein matting agent in undercoating layer of the photosensitive material is an inorganic or organic powder selected from silica, titanium dioxide, magnesium oxide, barium sulfate, calcium carbonate, polystyrene, alkylated polystyrene and (meth)acrylic esters.

* * * * *